US006991472B2

(12) United States Patent
Du et al.

(10) Patent No.: US 6,991,472 B2
(45) Date of Patent: Jan. 31, 2006

(54) ELECTRICAL CONNECTOR HAVING IMPROVED CONTACT

(75) Inventors: Shaoping Du, Kunsan (CN); Qisheng Zheng, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/993,610

(22) Filed: Nov. 19, 2004

(65) Prior Publication Data

US 2005/0112960 A1 May 26, 2005

(30) Foreign Application Priority Data

Nov. 21, 2003 (TW) ..... 92220606 U

(51) Int. Cl.
*H01R 12/00* (2006.01)

(52) U.S. Cl. ..... 439/66; 439/862

(58) Field of Classification Search ..... 439/66, 439/862

See application file for complete search history.

(56) References Cited

U.S. PATENT DOCUMENTS 4,738,625 A * 4/1988 Burton et al. ..... 439/59
4,875,863 A 10/1989 Reed
4,927,369 A * 5/1990 Grabbe et al. ..... 439/66
5,498,166 A 3/1996 Rothenberger
5,746,607 A 5/1998 Bricaud et al.
5,980,268 A * 11/1999 Mischenko et al. ..... 439/66
6,124,720 A * 9/2000 Pfaff et al. ..... 324/755
6,227,877 B1 5/2001 Mou et al.
6,312,263 B1 * 11/2001 Higuchi et al. ..... 439/66
6,551,149 B2 4/2003 Orihara
6,692,263 B2 * 2/2004 Villain et al. ..... 439/66
6,851,983 B2 * 2/2005 Yin et al. ..... 439/660
6,872,104 B2 * 3/2005 Sun ..... 439/862
2004/0127072 A1 * 7/2004 Matsunaga ..... 439/66
2004/0132319 A1 * 7/2004 Richter et al. ..... 439/66

* cited by examiner

*Primary Examiner*—Tho D. Ta
(74) *Attorney, Agent, or Firm*—Wei Te Chung

(57) ABSTRACT

An electrical connector (100) includes an insulative housing and a conductive contact assembled to the housing. The housing including a board (10) and opposite side walls (13) projecting upwardly and downwardly beyond the board. The board includes a top surface (11) and a bottom surface (12). The contact includes a base portion (20), a first spring arm (21) for engaging with an antenna (3) and a second spring arm (22) for resiliently pressing a printed circuit board (4). The second spring arm includes a retention portion (221) and a resilient portion (222) extending from the distal end of the retention portion. A bent is formed at a location between the retention portion and the resilient portion, whereby providing the resilient portion with enough flexibility.

12 Claims, 6 Drawing Sheets

ELECTRICAL CONNECTOR HAVING IMPROVED CONTACT

BACKGROUND OF THE INVENTION

1. Field of the Invention

The present invention relates to an electrical connector and more particularly, to an improved electrical connector for interconnection an antenna with a printed circuit board.

2. Description of the Related Art

It is becoming increasingly common practice to connect a plurality of terminals extending from an electrical connector with a plurality of circuit traces on a printed circuit board by mounting the connector on the same surface of the printed circuit board. Each terminal is coated with a solder composition. After a placement of the connector on the surface of the printed circuit board, the solder composition is melted so as to obtain the bond between the terminals and the circuit traces, thereby to obtain the electrically connection between the connector and the printed circuit board. One conventional electrical connector is disclosed in U.S. Pat. No. 6,227,877 issued to Mou on May 8, 2001. In this patent, the connector comprises an electrical contact including a retainer, a contact arm extending from a distal end of the retainer and a tail extending from an opposite end of the retainer. The retainer is received in a passageway defined in an insulative housing of the connector. The contact arm electrically engages with a contact pad formed on an electrical device (not shown). The tail is surface mounted to a circuit trace formed on a printed circuit board by soldering. Therefore, the contact electrically connects the connector with the printed circuit board.

However, as a solder portion of the connector, the tail is of a cantilevered configuration inclined to deflect and is too tiny to insure the connector securely mounting on the printed circuit board. In the other hand, the connector cannot be conveniently replaced after the tail is soldered to the printed circuit board. In fact, the replacement of the connector inevitably damages the circuit trace of the printed circuit board or the tail of the contact. Since the connector cannot be replaced conveniently, even a single damage can cause the whole to be wasted. This is economically inefficient, indeed. Furthermore, it must be recognized that the surface mounted electrical connector requires more space on the printed circuit board for the reason that the tail must extend laterally a short distance away from the housing of the connector. It can be minimized but it cannot be eliminated.

Hence, an electrical connector with improved contacts is needed to overcome the forgoing shortcomings.

BRIEF SUMMARY OF THE INVENTION

It is an object of the present invention to provide an electrical connector having a compact structure for interconnection an antenna with a printed circuit board.

It is a further object of the invention to provide an electrical connector with improved contact for resilient pressing with the printed circuit board.

To achieve the object described above, according to the present invention, there is provided an electrical connector for interconnection an antenna or the like with a printed circuit board including an insulative housing and a conductive contact assembled to the housing. The housing including a board and opposite side walls projecting upwardly and downwardly beyond the board. The board includes a top surface and a bottom surface. The side wall defines a slot adjacent to the top surface. The contact includes a base portion, a first spring arm extending upwardly and rearwardly from a front end of the base portion and a second spring arm extending downwardly and forwardly from opposite rear end of the base portion. The first spring arm has a contact portion for engaging with the antenna. The second spring arm has a contact section for resiliently pressing the printed circuit board. The second spring arm includes a retention portion and a resilient portion extending from the distal end of the retention portion. A bent is formed at a location between the retention portion and the resilient portion, whereby providing the resilient portion with enough flexibility.

Other objects, advantages and novel features of the invention will become more apparent from the following detailed description when taken in conjunction with the accompanying drawings.

BRIEF DESCRIPTION OF THE DRAWINGS

The foregoing summary, as well as the following detailed description of the embodiments of the present invention, will be better understood when read in conjunction with the appended drawings. For the purpose of illustrating the invention, there are shown in the drawings embodiments which are presently preferred. As should be understood, however, the invention is not limited to the precise arrangements and instrumentalities shown. In the drawings.

DETAILED DESCRIPTION OF THE PREFERRED EMBODIMENT

Figure 1:
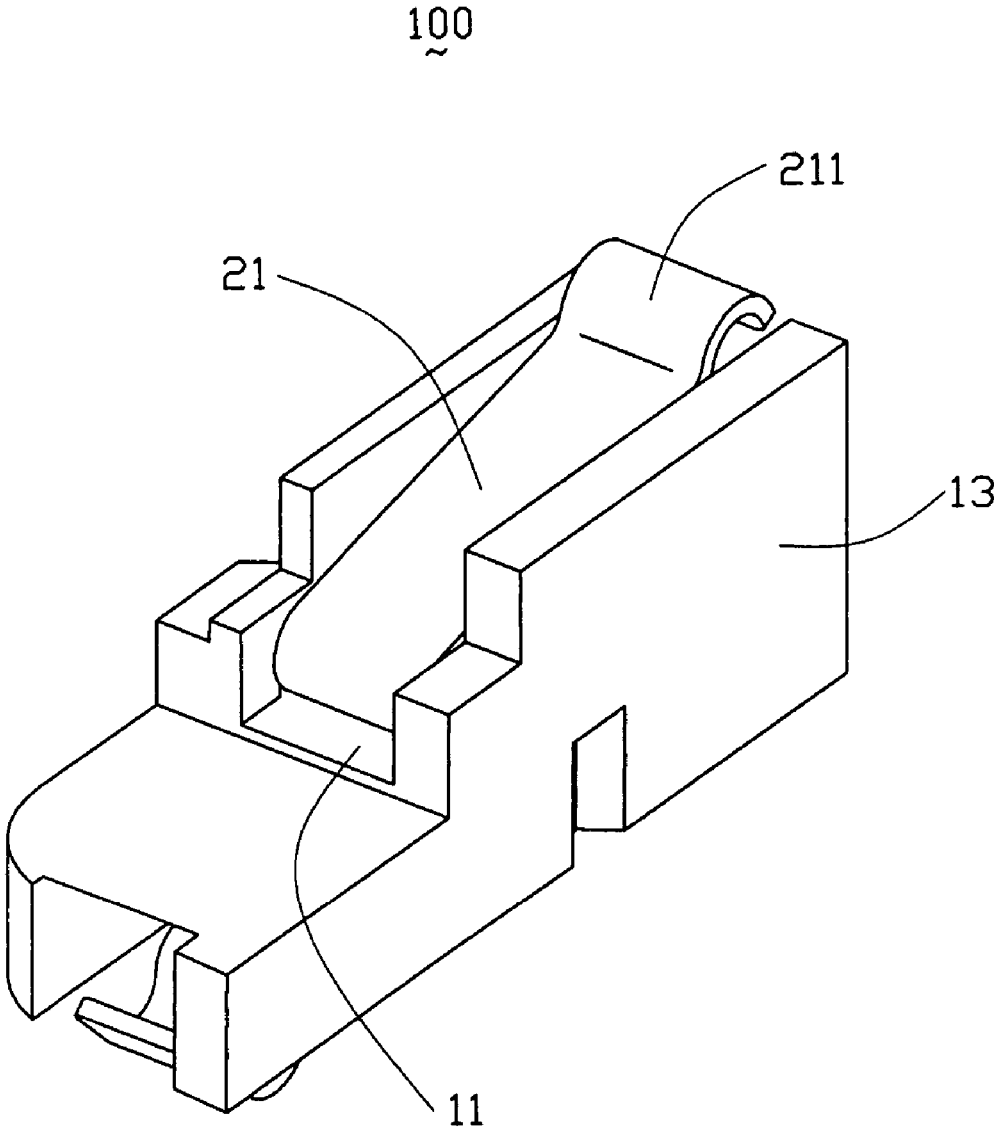
FIG. 1 is a perspective view of an electrical connector according to the present invention.

Certain terminology may be used in the following description for convenience only and is not considered to be limiting. The wards "upper", "lower", "front" and "rear" designate directions in the drawings to which reference is made. The words "forwardly", "rearwardly", "upwardly" and "downwardly" are further directions toward and away from, respectively, the geometric center of the referenced object. The terminology includes the wards above specifically mentioned, derivatives thereof, and words of similar import.

Figure 2:
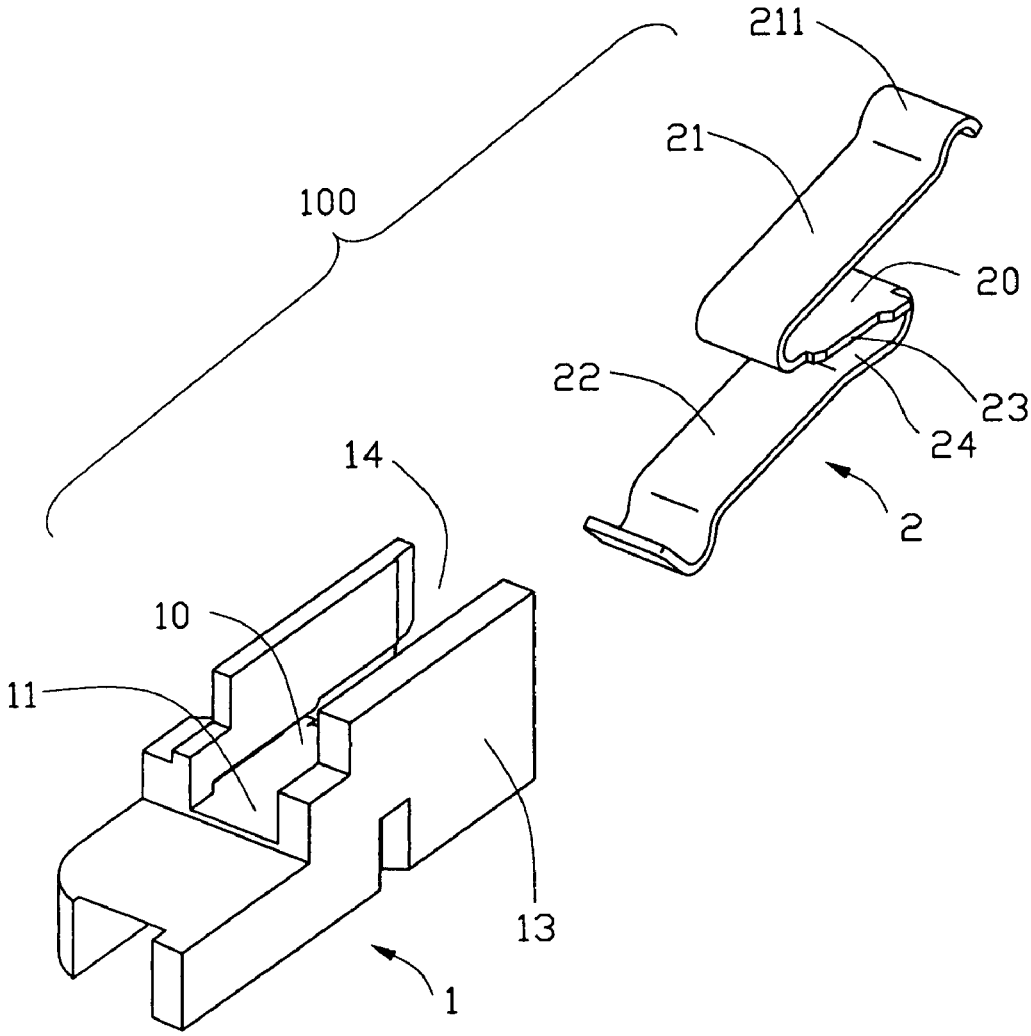
FIG. 2 is an exploded view of FIG. 1.
Figure 3:
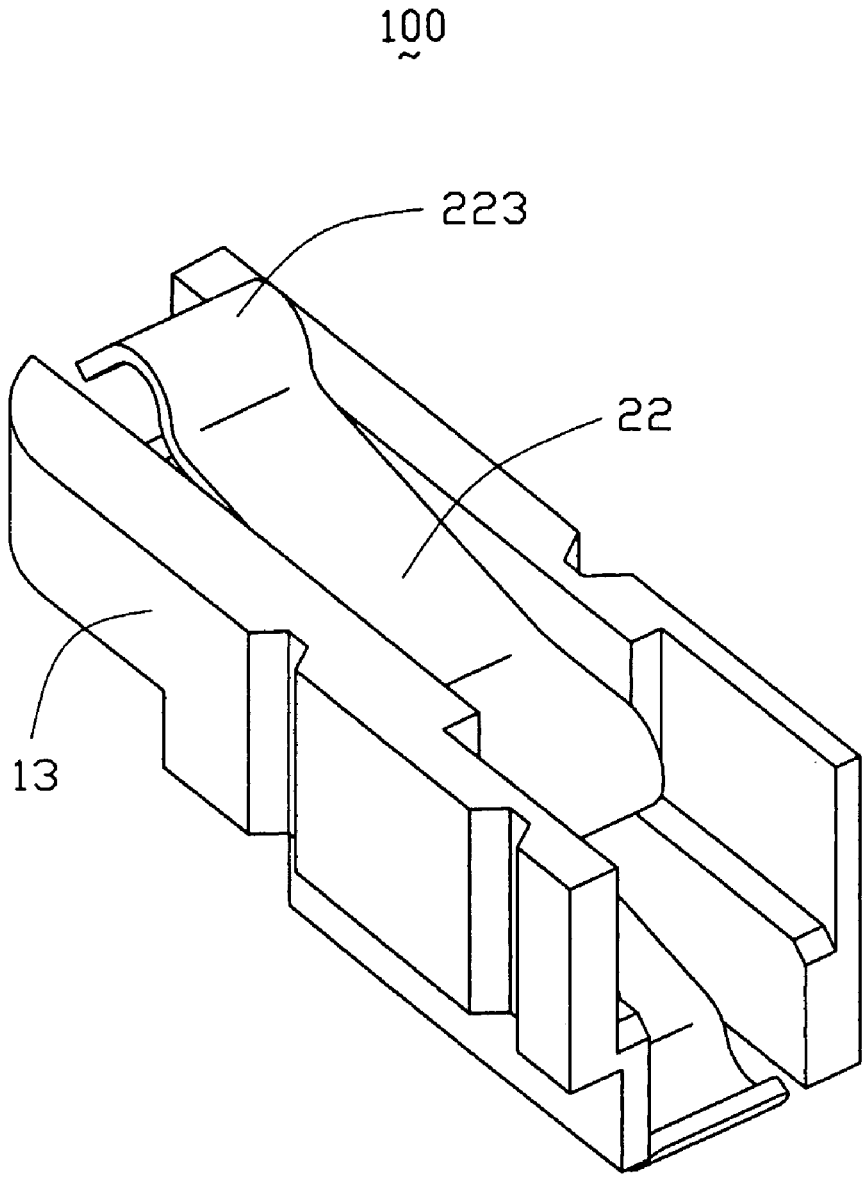
FIG. 3 is a perspective view of the electrical connector, but taken from a bottom view thereof for clarify.

Referring to the drawings in greater detail, and first to FIGS. 1 and 2, an electrical connector 100 according to the present invention includes an insulative housing 1 and a conductive press fit contact 2 assembled to the housing 1.

Referring to FIGS. 1–4, the housing 1 includes a substantially flat board 10 and opposite side walls 13 upwardly and downwardly projecting beyond the board 10. The board 10 includes a top surface 11 and a bottom surface 12. The top surface 11 and the side walls 13 corporately define a first space 14. The bottom surface 12 and the side walls 13 corporately define a second space 15. The bottom surface 12 includes an upper face 121 at a front portion thereof and a lower face 122 at a rear portion thereof. The lower face 122 cooperates with a rear edge of the top surface 11 to form a substantially U-shaped locating portion or partition 16. The side walls 13 symmetrically define a pair of slots 131 adjacent to the top surface 11.

Figure 4:
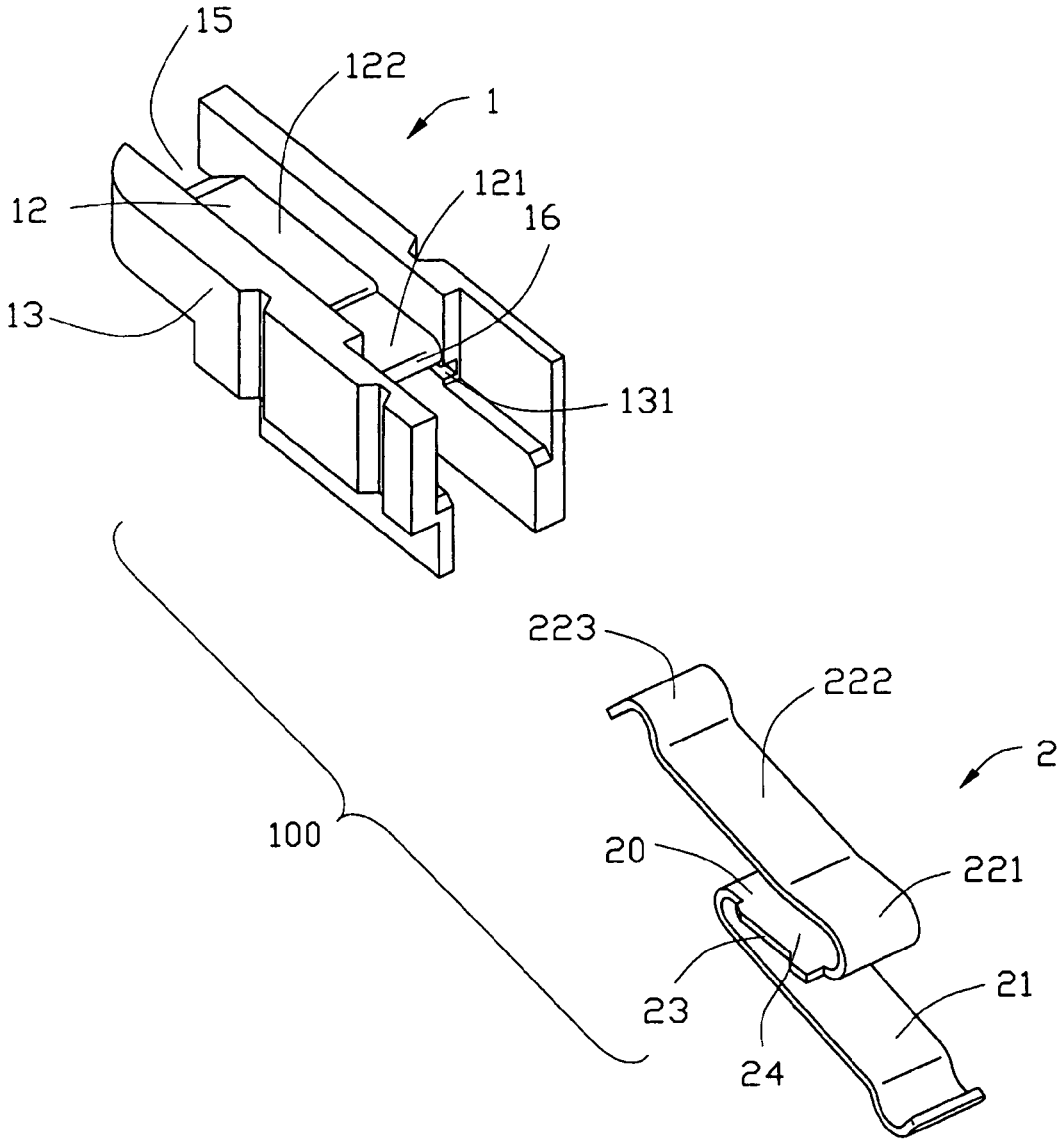
FIG. 4 is an exploded view of FIG. 3.
Figure 5:
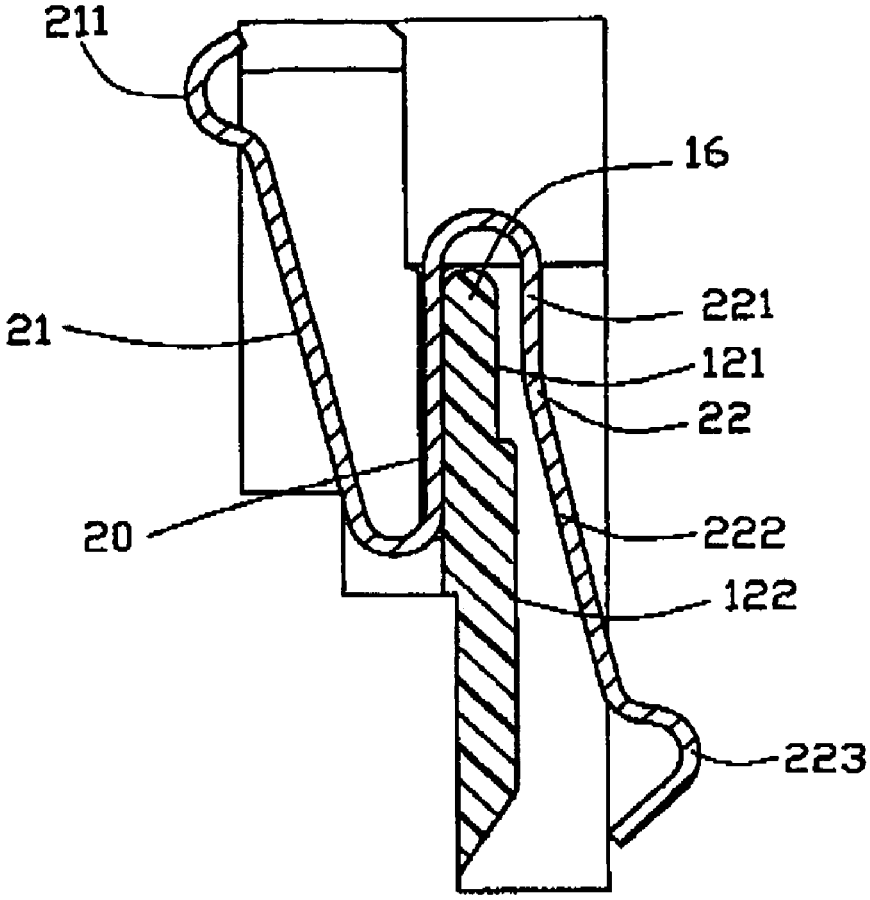
FIG. 5 is a longitudinal sectional view of the electrical connector.
Figure 6:
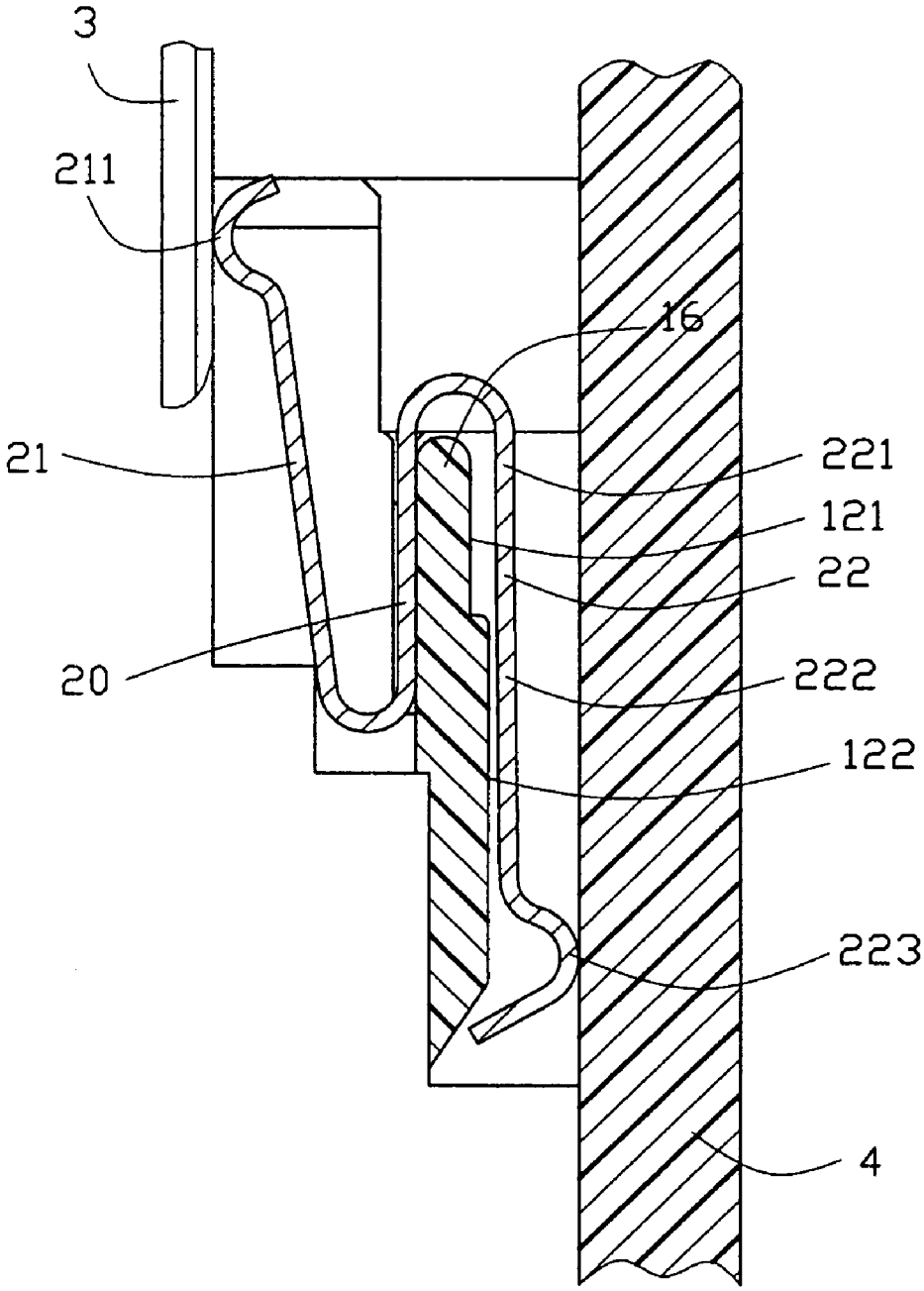
FIG. 6 is a longitudinal sectional view of the electrical connector similarly to FIG. 5, wherein an antenna and a printed circuit board are provided likely in use.

Referring to FIGS. 5 and 6 in conjunction with FIGS. 2 and 4, the contact 2 is of a generally S-shaped configuration. The contact 2 includes a substantially flat base portion 20, a first spring arm 21 extending upwardly and rearwardly from a front end of the base portion 20 and a second spring arm 22 extending downwardly and forwardly from an opposite rear end of the base portion 20. The base portion 20 symmetrically forms a pair of horizontal barbs 23 at opposite side edges thereof for latching in the slots 131 of the housing 1. The first spring arm 21 has a contact portion 211 at a distal end thereof. The contact portion 211 has an upper convex surface (not labeled) projecting upwardly beyond the first space 14 for engaging with a contact portion of a mating antenna 3. The second spring arm 22 has a retention portion 221 substantially parallel to the base portion 20 and a resilient portion 222 extending forwardly and downwardly from the retention portion 221, thereby a bent is formed at a location between the retention portion 221 and the resilient portion 222. The retention portion 221 extends from a rear end of the base portion 20 and cooperates with the base portion 20 to form a substantially U-shaped locating region 24. A projecting contact section 223 extends from a distal end of the resilient portion 222. The contact section 223 has a lower convex surface (not labeled) projecting downwardly beyond the second space 15 for surface engaging with a circuit trace of a mating printed circuit board (PCB) 4.

In assembly, the base portion 20 is located over the top surface 11 of the housing 1, the barbs 23 of the contact 2 forwardly move and are installed into the slots 131 of the housing 1, whereby the base portion 20 of the contact 2 fixedly assembled on the housing 1. The first spring arm 21 is received in the first space 14 and the contact portion 211 projects upwardly beyond the first space 14 for engaging with the contact portion of to antenna 3. The second spring arm 22 is received in the second space 15 and the contact section 223 projects downwardly beyond the second space 15 for engaging with the circuit trace of the PCB 4.

It is should be noted that the contact 2 employs the bent between the retention portion 211 and the resilient portion 212, the bent provides the resilient portion 212 with enough flexibility, ensuring the resilient portion 212 robustly come to normal position, thereby providing steadily connection with corresponding circuit trace of the PCB 4 and avoiding damage of the terminal 34. The electrical connector 100 of the present invention, therefore, has a long life-span.

It is important to note that successful execution of the electrical connector 100 is that the contact 2 employs the second spring arm 22 for resilient pressing with the PCB 4. The second spring arm 22 not only provides enough flexibility ensuring the connection with the PCB 4 but also is convenient and easy for users to replace when the electrical connector 100 does not work. Furthermore, the mechanical connection of the second spring arm 22 instead of the complicated solder process of the solder portion of the prior art largely reduces labor force and manufacture cost.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for interconnection an antenna with a printed circuit board, comprising:

an insulative housing including a board and opposite side walls upwardly and downwardly projecting beyond the board, the board including a top surface and a bottom surface, each side wall defining a slot; and a conductive contact including a base portion for being fixed to the slot of the housing, a first spring arm and a second spring arm, the first spring arm having a contact portion for engaging with an antenna, the second spring arm having a contact section for resiliently pressing a printed circuit board, the second spring arm including a retention portion and a resilient portion extending from a distal end of the retention portion, a bent formed at a location between the retention portion and the resilient portion, whereby providing the resilient portion with enough flexibility; wherein the insulative housing defines an indentation in the bottom surface of the board and adjacent to the bent of the second spring arm of the contact, the resilient portion of the second spring arm abuts against the bottom surface of the board due to a pressure of the printed circuit board, while the bent of the second spring arm is always spaced apart from the bottom surface of the board due to the indentation of the housing.

2. The electrical connector according to claim 1, wherein the first spring arm extends upwardly and rearwardly from a front end of the base portion and the second spring arm extends downwardly and forwardly from an opposite rear end of the base portion.

3. The electrical connector according to claim 1, wherein the slot of the side wall is adjacent to the top surface, and wherein the base portion forms a barb at a side thereof for fixedly engaging with the slot of the housing.

4. The electrical connector according to claim 1, wherein the top surface and the side walls cooperatingly define a first space, and the bottom surface and the side walls cooperatingly define a second space, the first spring arm being received in the first space and the second spring arm being received in the second space.

5. The electrical connector according to claim 4, wherein the contact portion of the first spring arm has an upper convex surface projecting upwardly beyond the first space, and the contact section of the second spring arm has a lower convex surface projecting downwardly beyond the second space.

6. An electrical connector comprising:

an insulative housing defining vertically first and second spaces divided by a partition which extends horizontally;

a retention slot formed in said first space and extending horizontally adjacent to said partition;

a contact including:

a retention section extending horizontally and initially inserted into the retention slot along said horizontal direction and eventually retainably received in said retention slot;

a first resilient contact arm curvedly extending from a far end of the retention section; and a second resilient contact arm curvedly extending from the near end of the retention section opposite to the first resilient contact arm both vertically and horizontally; wherein said first resilient contact arm is located in the first space and the second resilient contact arm is located in the second space; wherein said second resilient contact arm extends from the near end initially in a horizontal manner to form a horizontal section and successively in an oblique manner to form a resilient portion; and wherein said partition forms a recess to comply with said horizontal section of the second resilient contact arm.

7. The connector as claimed in claim 6, wherein the first resilient contact ann extends away from the partition vertically, and the second resilient contact arm extends toward and beyond the partition vertically.

8. The connector as claimed in claim 6, wherein said first resilient contact arm extends from the far end in a slanted manner directly.

9. The connector as claimed in claim 7, wherein the first resilient contact arm and the second resilient contact arm are imposed forces thereon in the first and the third directions, respectively, to be compressed toward each other.

10. The connector as claimed in claim 7, wherein said housing is elongated horizontally, and contact points of said first and second resilient contact arms are respectively located around two opposite horizontal ends of said housing.

11. An electrical connector comprising:

an elongated insulative housing defining two opposite lengthwise ends along a horizontal direction thererof;

an S-like contact disposed in the housing, said S-like contact including:

a horizontal base extending in said horizontal direction, retained in a horizontal retention slot and supported, in a vertical direction perpendicular to said horizontal direction, by a horizontal board which separates upper and lower portions of the housing in said vertical direction perpendicular to said horizontal direction; and first and second resilient contact arms respectively extending curvedly from opposite ends of the base in an opposite manner not only vertically but also horizontally, toward the corresponding upper and lower portions of the housing;

wherein contact points of the first and second resilient contact arms are respectively essentially located at said two opposite lengthwise ends of the housing horizontally and spaced far from each other horizontally.

12. The connector as claimed in claim 11, wherein said first and second resilient contact arms are imposed forces thereon vertically to be compressed toward each other.

* * * * *